US005875714A

United States Patent [19]

Winkler et al.

[11] Patent Number: 5,875,714

[45] Date of Patent: Mar. 2, 1999

[54] PROTECTIVE DEVICE ON PRINTING PRESSES

[75] Inventors: Peter Winkler, Münsingen; Max Egger, Thun; Andres Miescher, Ittigen, all of Switzerland

[73] Assignee: Maschinenfabrik Wifag, Bern, Switzerland

[21] Appl. No.: 949,970

[22] Filed: Oct. 14, 1997

[30] Foreign Application Priority Data

Oct. 15, 1996 [DE] Germany ..... 196 42 561.1

[51] Int. Cl.[6] ..... B41F 5/00

[52] U.S. Cl. ..... 101/216; 101/425; 100/53

[58] Field of Search ..... 101/216, 219, 101/212, 181, 424.2, 425; 100/53

[56] References Cited

U.S. PATENT DOCUMENTS

| | | | |
|---|---|---|---|
| 4,295,421 | 10/1981 | Abendroth et al. | 101/216 |
| 4,454,812 | 6/1984 | Johne et al. | 101/212 |
| 4,669,380 | 6/1987 | Selb et al. | 101/212 |
| 4,870,900 | 10/1989 | Robertson | 101/425 |
| 4,905,396 | 3/1990 | Kobler | 101/425 |
| 5,024,155 | 6/1991 | Jahn | 101/216 |
| 5,241,903 | 9/1993 | Lample | 100/53 |
| 5,373,787 | 12/1994 | Junghans et al. | 101/212 |
| 5,613,438 | 3/1997 | Rethberg | 101/216 |
| 5,699,734 | 12/1997 | Bitterich | 101/216 |

FOREIGN PATENT DOCUMENTS 44 02 158 C1 2/1995 Germany .

*Primary Examiner*—Eugene Eickholt
*Attorney, Agent, or Firm*—Mcglew and Tuttle

[57] ABSTRACT

A protective device is provided on printing presses with a two-dimensional protective cover. The cover is mounted pivotably around a pivot axis in a press frame and shields a cylinder pair from access by an operating personnel and grants access to the said cylinder pair after pivoting off from the cylinder pair. The cylinder pair comprises a rubber blanket cylinder and a plate cylinder. A separate protective cover is provided for each of the cylinder pairs of a printing tower with "U" and "N" (type) bridge elements arranged alternatingly one on top of another.

4 Claims, 3 Drawing Sheets

PROTECTIVE DEVICE ON PRINTING PRESSES

FIELD OF THE INVENTION

The present invention pertains to a protective device on printing presses for with a two-dimensional protective cover which is mounted pivotably around a pivot axis in a press frame and shields a cylinder pair from access by operating personnel and more particularly relates to a device with a rubber blanket cylinder and a plate cylinder wherein access to the cylinder pair is granted after pivoting off the protective cover from the cylinder pair.

BACKGROUND OF THE INVENTION

A protective device of this type has been known from DE 44 02 158 C1.

SUMMARY AND OBJECTS OF THE INVENTION

The primary object of the present invention is to propose a protective device for printing presses, which protects print positions involved in the printing process from unauthorized access, on the one hand, and makes the print positions not involved in the printing process accessible for maintenance procedures or repair by opening the protective device, on the other hand.

According to the invention, a protective device is provided on printing presses with a two-dimensional protective cover. The cover is mounted pivotably around a pivot axis in a press frame and shields a cylinder pair from access by an operating personnel and grants access to the said cylinder pair after pivoting off from the cylinder pair. The cylinder pair comprises a rubber blanket cylinder and a plate cylinder. A separate protective cover is provided for each of the cylinder pairs of a printing tower with "u" and "n" shape (type) bridge elements arranged alternatingly one on top of another.

A pivotable protective cover shielding the cylinder pair in a two-dimensional pattern is associated according to the present invention with each cylinder pair, comprising a rubber blanket cylinder and a plate cylinder each. Each protective cover can be pivoted individually into its corresponding protective position or out of that protective position. It becomes possible as a result to make individual cylinder pairs accessible for maintenance or repair procedures, while the other cylinder pairs of the same printing press are in operation.

By arranging the pivot axes of the protective covers within the area of the printing tower limited by the outer circumference of the plate cylinders and close to the imaginary center line between two bridge elements of the printing tower located one on top of another, the protective device occupies an especially small additional space according to the present invention.

According to a preferred embodiment of the present invention, access from a stopped cylinder pair to an adjacent cylinder pair still in operation is prevented via a cover pivoted out of its protective position by the arrangement of a horizontal separating surface, which may also be replaced with a device of the machine used for another purpose, preferably a pivotable washing device.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

DESCRIPTION OF THE PREFERRED EMBODIMENTS

Figure 1:
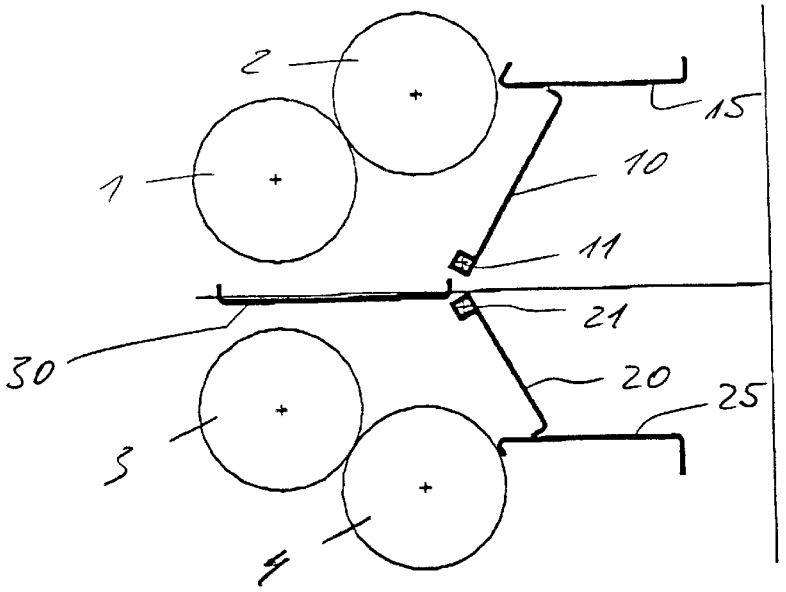
FIG. 1 is a schematic view showing two cylinder pairs of a "u" and an "n" bridge element, which pairs are arranged one on top of another in a printing tower, with a protective cover located in the protective position each.

Referring to the drawings in particular, FIG. 1 shows two cylinder pairs of an "n" bridge element arranged on one side of a web passing through and of a "u" bridge element arranged above same. A plurality of such "n" and "u" bridge elements are arranged alternatingly one on top of another in a printing tower. The cylinder pairs shown are formed by a respective rubber blanket cylinder 1 and 3 and a respective plate cylinder 2 and 4.

A two-dimensional protective cover 10 and 20, mounted pivotably in a press frame, is associated with each of the cylinder pairs 1, 2 and 3, 4. The protective covers 10 and 20 have a one-piece, flat design and shield one cylinder pair against unauthorized access by an operator. The two protective covers 10 and 20 are shown in their protective positions in FIG. 1. A horizontal cover plate acting as a separating surface 30 is detachably fastened to the press frame, preferably by means of rapid couplings, between the two rubber blanket cylinders 1 and 3 located one above the other. The separating surface 30 prevents access to each of the two cylinder pairs 1, 2 and 3, 4 from the side of the respective adjacent cylinder pair, if the protective cover of that cylinder pair has been pivoted out of its protective position, e.g., for the purpose of maintenance procedures.

Each of the protective covers 10 and 20 is mounted in the press frame pivotably around a pivot axis 11 and 21, respectively. The pivot axes 11 and 21 extend in the axial direction of the cylinder. The pivot axes 11 and 21 are arranged within the triangular area left free between respective cylinder pairs 1, 2 and 3, 4 located one above the other. The protective covers 10 and 20 can be pivoted around their respective pivot axes away from the cylinder pair associated with them, i.e., from the cylinder pair to be shielded, in the direction of the other protective cover from their protective positions.

Figure 2:
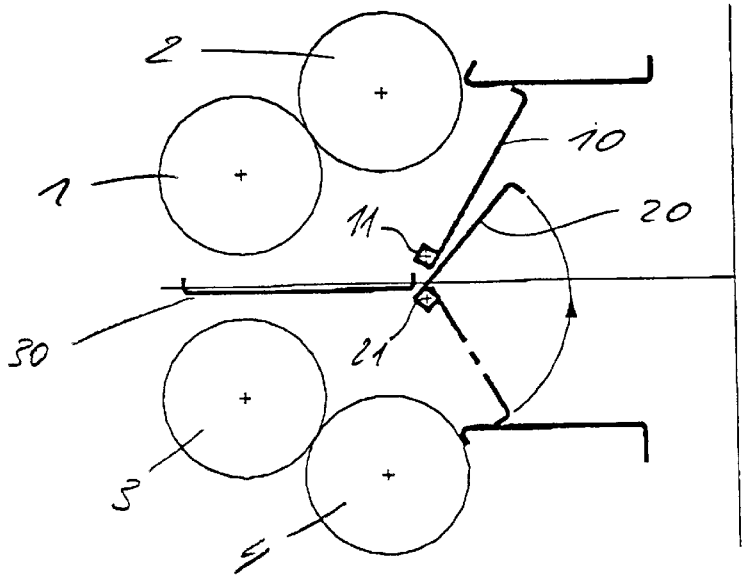
FIG. 2 is a view of the cylinder pairs with protective covers corresponding to FIG. 1, but with the lower protective cover pivoted out of the protective position.

The lower protective cover 20 for the cylinder pair of the "n" bridge element is pivoted off in the upward direction in FIG. 2. This cylinder pair 3, 4 is thus accessible to the operating personnel. However, the access to the other cylinder pair 1, 2 is prevented by the separating surface 30. The latter cylinder pair 1, 2 thus can continue printing, while maintenance may be performed on the cylinder pair 3, 4 located directly under it.

Figure 3:
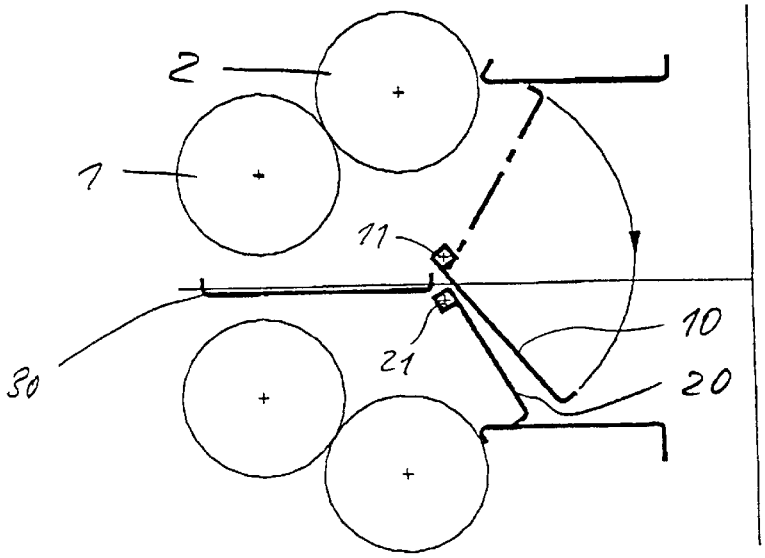
FIG. 3 is a view of the arrangement according to FIGS. 1 and 2, but with the upper protective cover pivoted off.

FIG. 3 shows the case in which the upper cylinder pair 1, 2 has been made accessible for maintenance procedures by the protective cover 10 associated with that cylinder pair having been pivoted downward out of its protective position.

The separating surface extends on one side to the vicinity of the web passing through and extends on the other side to the vicinity of the adjacent pivot axes 11 and 21 of the protective covers 10 and 20. One additional cover 15 and 25 each is arranged opposite the free ends of the protective covers 10 and 20 in their protective position. These additional cover elements 15 and 25 are inherently present at the printing press; however, if they are not present, they are to be arranged as shown in FIGS. 1 through 5. Each of the cylinder pairs is thus protected from unauthorized access, inaccessible to the operator, by a shield indicated by a nearly closed line in FIGS. 1 through 5. The line extends from the respective additional cover 15 and 25 over the respective protective cover 10 and 20 located in the protective position, which then extends into the area between the rubber blanket cylinders 1 and 3 of two bridge elements located one on top of another through the separating surface 30. The additional cover elements 15 and 25 extend essentially horizontally to the respective adjacent plate cylinder 2 and 4 and may advantageously be used as stops for the free end of the respective protective cover 10 and 20.

The operator may support himself on the respective lower protective element 25 during the performance of maintenance or repair procedures.

As is shown in FIGS. 1 through 5, the protective cover according to the present invention requires extremely little additional space. It is merely pivoted between two bridge elements arranged one on top of another. Additional bridge elements are not affected. The space between an "N" bridge element and a "U" bridge element arranged above it, which space is present anyway, is thus used according to the present invention for the purposes of the protective device. It may be advantageous in this connection to displace the pivot axes 11 and 21 of the protective covers 10 and 20 in the direction of the web passing through vertically or toward the rubber blanket cylinders 1 and 3 arranged one on top of another to the extent possible.

Figure 4:
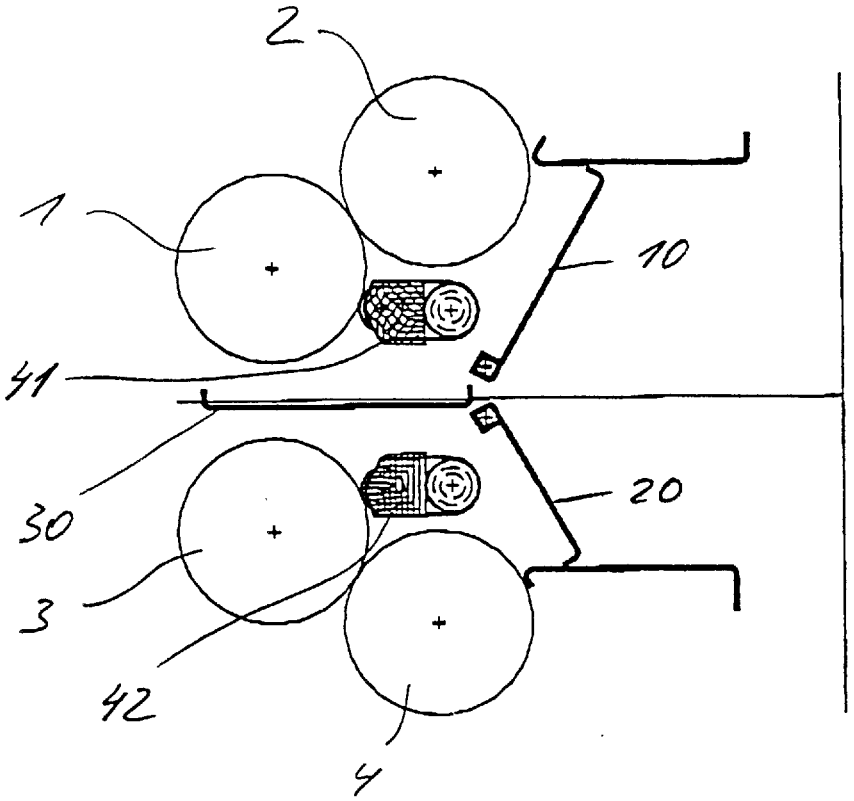
FIG. 4 is a view of the arrangement according to FIG. 1 with one washing device for each of the cylinder pairs.

FIG. 4 shows the arrangement according to FIG. 1, wherein a washing device 41 associated with the rubber blanket cylinder 1 and a washing device 42 associated with the rubber blanket cylinder 3 are additionally shown. The two washing devices 41 and 42 are arranged in the respective space shielded by the protective covers 10 and 20 above and below the separating surface 30, respectively.

Figure 5:
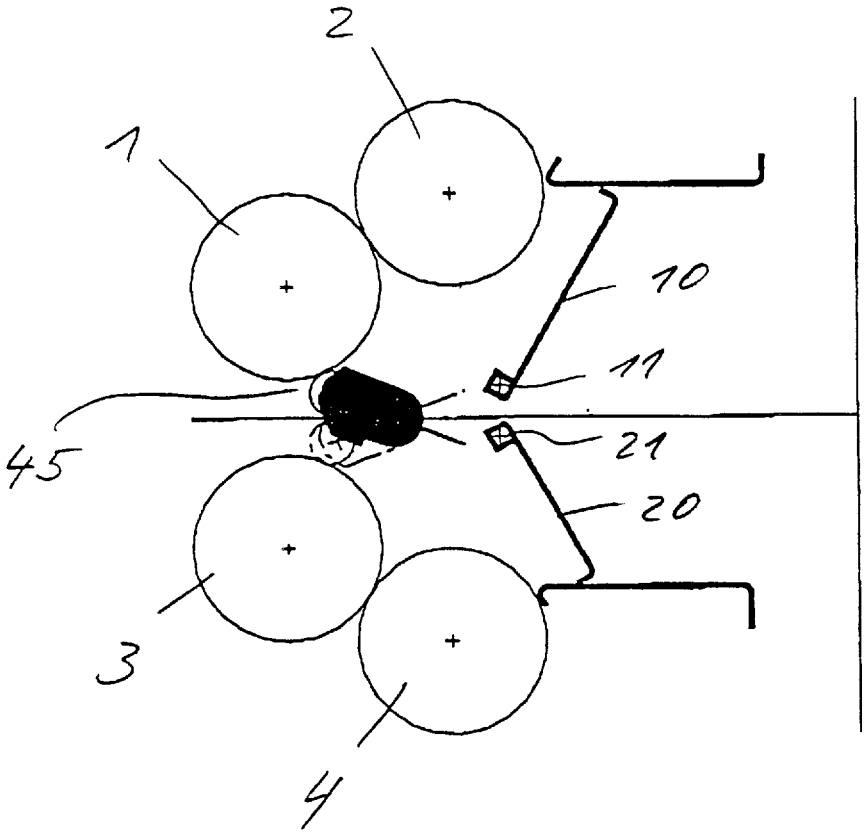
FIG. 5 is a view of the arrangement according to FIG. 1 with a pivotable washing device between the two cylinder pairs arranged one on top of another.

The individual associated washing devices 41 and 42 according to FIG. 4 are replaced in FIG. 5 with a single washing device 45, which is mounted pivotably approximately on the imaginary center line between the rubber blanket cylinders 1 and 3 arranged one on top of another such that either the rubber blanket cylinder 1 or the lower rubber blanket cylinder 3 can be washed, depending on the pivoted position of that washing device 45. The washing device 45 assumes the separating function of the separating surface 30 in this central arrangement. An additional cover to form the separating surface 30, as is shown in FIGS. 1 through 4, may be eliminated. The pivot axis of the washing device 45 extends in the longitudinal direction of the cylinder and is located approximately on the center line between the two rubber blanket cylinders arranged one on top of another in the area between an imaginary connection line between the pivot axes of these rubber blanket cylinders and of an imaginary connection line between the pivot axes 11 and 21 of the protective covers 10 and 20.

Figure 6:
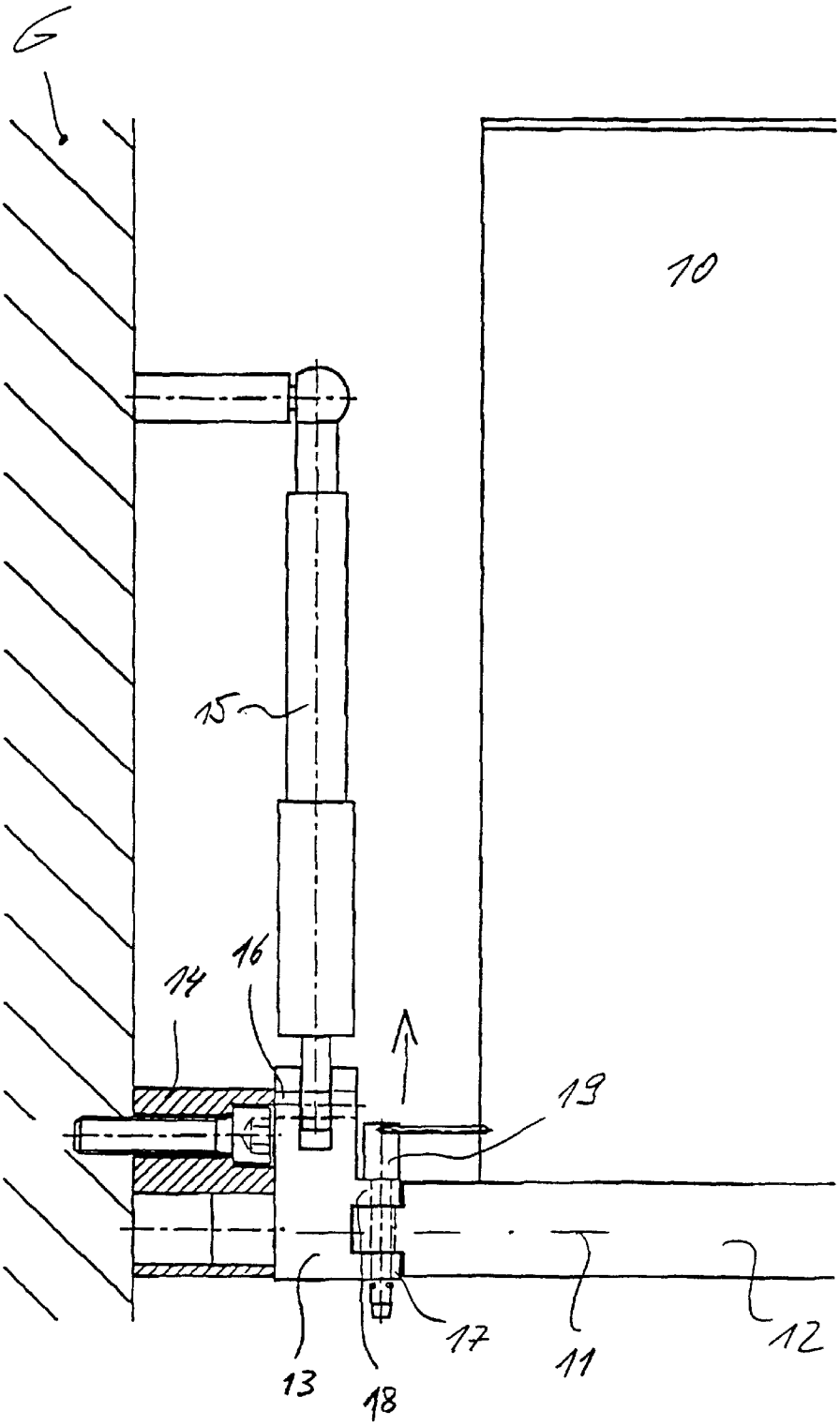
FIG. 6 is a view of a pivoting mechanism for the protective covers according to FIGS. 1 through 5, which can be pivoted off.

FIG. 6 shows an example of a pivoting mechanism for the protective cover 10. A crank 13 is mounted on the press frame G rotatably around its shaft journal. A pillow block 14 fastened to the press frame G is used as the bearing. A gas pressure spring 15 is articulated to the lever arm 13 rotatably around an axis extending in parallel to the pivot axis 12 of the protective cover 10 by means of a pin 16. The gas pressure spring 15 is supported at its other end at the press frame G by means of an additional hinge or ball joint. On its side facing the protective cover 10 in the plane of the picture according to FIG. 6, the lever arm 13 has two webs 17 and 18, which are arranged in a U-shaped pattern in relation to one another. The two webs 17 and 18 are provided with a hole each, through which the pins 19 used as a quick connection for the protective cover 10, can be introduced. The protective cover 10 is seated on a shaft 12, which engages with one of its ends the U-shaped bearing formed by the webs 17 and 18. At its end engaging the U, the shaft 12 is also provided with a hole, into which the pin 19 is introduced. The connection between the crank 13 and the protective cover 10 or its shaft 12 is thus established. The protective cover 10 can thus be removed by simply pulling out the pin 19. At its end projecting beyond the U-shaped bearing 17, 18, the pin 19 is provided with balls to which pressure is applied or with other suitable means in order to prevent the pin 19 from falling out accidentally in all pivoted positions.

FIG. 6 shows a preferred embodiment of the pivoting mechanism for the protective cover 10, in which the shaft 12 of the protective cover 10 is fastened to the crank 13 such that an additional rotary movement around the rotary mount of the crank 13 on the press frame G is superimposed to the pivoting of the protective cover 10 around its pivot axis 11. The pivot axis 11 is fastened to the crank 13 for this purpose eccentrically to the pivot axis of the crank 13. Due to this eccentric fastening, the protective cover actually pivoted out of the protective position can be pivoted to the respective adjacent protective cover in parallel or nearly in parallel. The protective cover 10 is mounted on the press frame G on both sides by means of a pivoting mechanism, as is shown in FIG. 6.

While specific embodiments of the invention have been shown and described in detail to illustrate the application of the principles of the invention, it will be understood that the invention may be embodied otherwise without departing from such principles.

What is claimed is:

1. A protective device on a printing press, comprising:

a press frame;

a cylinder pair including a rubber blanket cylinder and a plate cylinder;

a two-dimensional protective cover mounted pivotably around a pivot axis in said press frame for shielding said cylinder pair from access by operating personnel and providing access to the said cylinder pair after pivoting off from the said cylinder pair, said protective cover including a separate protective cover portion provided for each of said cylinder pairs of a printing tower with "u" and "n" bridge elements arranged alternatingly one on top of another.

2. The protective device in accordance with claim 1, wherein said pivot axes of said protective covers are arranged within an area of the printing tower limited by an outer circumference of said plate cylinders and close to an imaginary center line between two said bridge elements of the printing tower located one on top of another.

3. The protective device in accordance with claim 1, wherein said separating surface is detachably arranged between said rubber blanket cylinders of two bridge elements located one on top of another in the printing tower.

4. The protective device in accordance with claim 1, further comprising a washing device arranged between two said rubber blanket cylinders arranged one on top of another, said washing device forming an additional protective cover.

* * * * *